US008353068B1

(12) United States Patent
Bailey et al.

(10) Patent No.: US 8,353,068 B1
(45) Date of Patent: Jan. 15, 2013

(54) ROTATABLY POSITIONABLE HAND RAIL

(76) Inventors: John W Bailey, Bakersfield, CA (US); Steven H Bailey, Bakersfield, CA (US)

( * ) Notice: Subject to any disclaimer, the term of this patent is extended or adjusted under 35 U.S.C. 154(b) by 0 days.

(21) Appl. No.: 13/490,350

(22) Filed: Jun. 6, 2012

(51) Int. Cl.
*A47K 3/024* (2006.01)

(52) U.S. Cl. ..... 4/576.1; 211/105.1; 248/222.52; 16/446

(58) Field of Classification Search ..... 4/576, 1–577.1; 211/95, 105.1; 248/222.52, 251, 349.1, 309.1, 248/346.06; 16/444, 446
See application file for complete search history.

(56) References Cited

U.S. PATENT DOCUMENTS

| | | | | |
|---|---|---|---|---|
| 1,147,348 | A | 7/1915 | Wadsworth | |
| 1,367,290 | A | 2/1921 | Williams | |
| 1,725,802 | A | 8/1929 | Hoegger | |
| D93,716 | S | 10/1934 | Hesler | |
| 2,067,591 | A | 1/1937 | Balmer | |
| 2,188,851 | A | 7/1938 | Culver | |
| D118,014 | S | 12/1939 | Grimm | |
| 2,269,420 | A | 1/1942 | Anderson et al. | |
| 2,436,903 | A | 3/1948 | Schafer | |
| 2,564,190 | A | 8/1951 | Danielson | |
| D173,415 | S | 11/1954 | Du Brie | |
| D188,175 | S | 6/1960 | Craig | |
| D189,906 | S | 3/1961 | Best et al. | |
| 3,156,944 | A | 11/1964 | Bohn | |
| 3,302,594 | A * | 2/1967 | Barnett et al. | 248/349.1 |
| D211,877 | S | 8/1968 | Doman | |
| 3,633,862 | A | 1/1972 | Breen | |
| 3,813,071 | A | 5/1974 | Noryd | |
| D233,756 | S | 11/1974 | Schrock | |
| D265,582 | S | 7/1982 | Kohler, Jr. | |
| D275,782 | S | 10/1984 | Burgess et al. | |
| D282,963 | S | 3/1986 | Alger | |
| 4,659,050 | A * | 4/1987 | Tabayashi | 248/349.1 |
| 5,050,252 | A | 9/1991 | Cuttriss | |
| 5,174,538 | A * | 12/1992 | Okada | 248/349.1 |
| 5,577,275 | A | 11/1996 | Guenther | |
| 5,779,309 | A * | 7/1998 | Lu | 248/349.1 |
| 6,546,596 | B2 * | 4/2003 | Grote et al. | 16/429 |
| 7,373,694 | B1 | 5/2008 | Kopp | |
| 7,484,269 | B2 * | 2/2009 | Chih et al. | 16/340 |
| 7,774,902 | B2 | 8/2010 | Whyzel | |
| 8,122,530 | B1 | 2/2012 | Bailey et al. | |
| 2009/0211013 | A1 * | 8/2009 | Graff et al. | 4/576.1 |

* cited by examiner

*Primary Examiner* — Gregory Huson
*Assistant Examiner* — Erin Deery
(74) *Attorney, Agent, or Firm* — James M. Duncan, Esq.; Klein, DeNatale, Goldner, Cooper, et al.

(57) ABSTRACT

The present invention provides an adjustable hand rail including a wall-mounted base member that includes a circular plate with an inward facing side and an outward facing side. The circular plate includes a circular track. The circular track has a bottom, an inside rail member extending from the bottom and an outside rail member extending from the bottom. The two rail members define a C-shaped channel. The bottom of the track member also includes a plurality of lock apertures. A rotatable insert is rotatably disposed within the circular track. The insert has a first insert opening and a diametrically opposed second insert opening. First and second shoulder members are disposed within the insert openings. The first shoulder member has a first locking pin biased to extend into one of the lock apertures. A bar having a first end and a second end is provided attached to the shoulder members.

12 Claims, 8 Drawing Sheets

ROTATABLY POSITIONABLE HAND RAIL

RELATED APPLICATIONS

Not Applicable.

BACKGROUND OF THE INVENTION

1. Field of the Invention

The present invention relates generally to safety devices utilized to support and balance a person, and more specifically to a devices for providing a person with a handhold in order to prevent a fall, or device for a person to grab if the person starts to fall.

2. Background

Presently known hand rails generally are mounted in a fixed position, which generally varies from horizontal, vertical, or, when adjacent to stairs or steps, an angle which corresponds to the angle of the stairs or steps. Because the position of the hand rail is fixed, the user must have his or her hand in one general position in order to grab the bar. However, it is not always possible for a user to easily position their hands in a position which is conducive to obtaining and maintaining a secure grasp of the rail. For example, for a variety of health-related reasons, many people have limited range of motion in their elbows, wrists, and/or shoulders, which can make the positioning of the hand in a position allowing the most secure handhold to be problematic for a hand rail having a fixed position. Because the hand rail must reliably support the user's entire weight, the inability to obtain and maintain a secure grasp on the rail may defeat the purpose for which the rail is intended.

SUMMARY OF THE INVENTION

The present invention provides an adjustable hand rail including a wall-mounted base member that includes a circular plate with an inward facing side and an outward facing side. The circular plate has a peripheral edge and a circular track disposed at the peripheral edge. The circular track has a bottom, an inside rail member extending from the bottom and an outside rail member extending from the bottom. The inside rail member is concentric with the outside rail member and the two rail members define a C-shaped channel having an outward facing opening opposite the bottom of the track member. The bottom of the track member also includes a plurality of lock apertures. A rotatable insert is rotatably disposed within the circular track. The insert has a first insert opening and a diametrically opposed second insert opening. A first shoulder member is provided, disposed within the first insert opening. The first shoulder member has a first locking pin biased to extend into one of the lock apertures. The width of the first shoulder member is larger than the outward facing opening of the C-shaped channel so that the first shoulder member is disposed within the C-shaped channel. A second shoulder member is disposed within the second insert opening. The width of the second shoulder member is larger than the outward facing opening of the C-shaped channel such that the second shoulder member is disposed within the C-shaped channel. A bar having a first end and a second end is provided. The first end of the bar is fixedly attached to the first shoulder member and the second end of the bar is fixedly attached to the second shoulder member.

In another aspect of the invention, the rotatable insert includes a first insert member and second insert member, the first insert member having a first insert opening and a pair of upper flanges at either end. The second insert member has a second insert opening and includes a pair of lower flanges at either end. When the upper flanges of the first insert member are mated with the lower flanges of the second insert member, a substantially circular rotatable insert is formed.

In another aspect of the invention, the circular track is an integral part of the circular plate.

In another aspect of the invention, the inside rail member and outside rail member each comprise a flanged end.

In another aspect of the invention, the bar includes a handle having a gripping surface.

In another aspect of the invention, the first shoulder member includes a first hand retractable plunger with a first end and a second end. The first end of the hand retractable plunger is the first locking pin, and the second end of the hand retractable plunger is the first locking handle.

In another aspect of the invention, the first shoulder member includes a spring for biasing the first locking pin into the first of the lock apertures.

In another aspect of the invention, the second shoulder member includes a second locking pin biased to extend into a second of the lock apertures, and a second locking handle for retracting the second locking pin from the second lock aperture.

In another aspect of the invention, the second shoulder member includes a second hand retractable plunger with a first end and a second end. The first end of the second hand retractable plunger is the second locking pin and the second end of the second hand retractable plunger is the second locking handle.

DETAILED DESCRIPTION OF THE INVENTION

Figure 1:
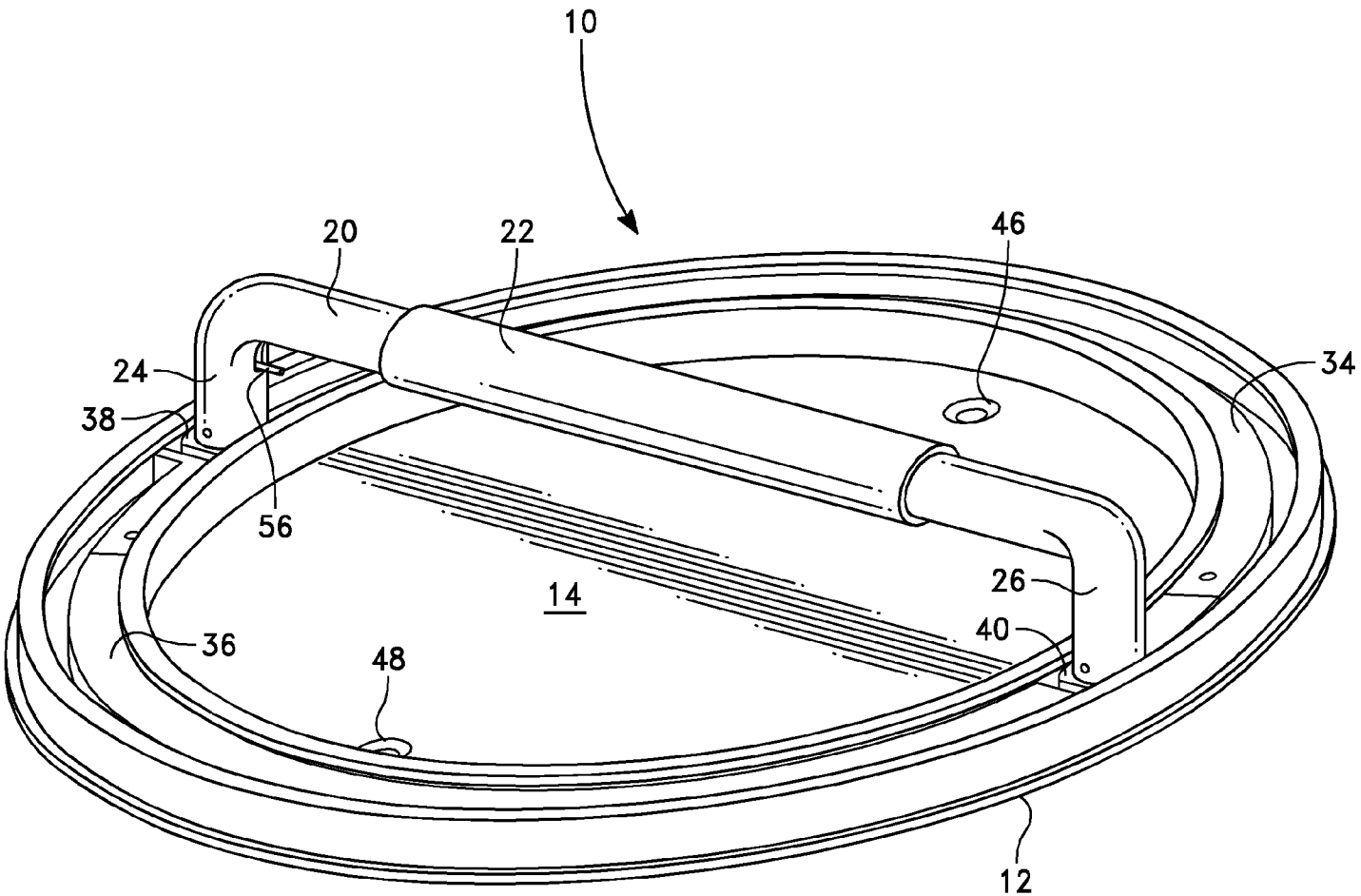
FIG. 1 is a perspective view of an embodiment of a hand rail of the present invention.

Turning to the drawings, wherein like numerals indicate like parts, one embodiment of an adjustable hand rail 10 of the present invention includes a wall-mountable base 12, and a bar 20 that mounts to the wall-mountable base 12 as described below. Bar 20 is manually rotatable with respect to wall-mountable base 12. Wall-mountable base 12 further includes a circular plate 14 having an inward facing side 16 and an outward facing side 18, and a circular track 82. A rotatable insert 32 is preferably disposed within circular track 82, bar 20 being fixed thereto and rotating by a corresponding rotation of rotatable insert 32.

Looking at the Figures in greater detail, FIG. 1 provides a perspective view of one embodiment of an assembled adjustable hand rail 10 of the present invention. Adjustable hand rail 10 includes a wall-mounted base member 12. The wall-mounted base member 12 includes a circular plate 14 having an inward facing side (not shown), and an outward facing side 18. Circular plate 14 also has a peripheral edge. Base member 12 has a circular track 82 disposed at the peripheral edge thereof. Circular track 82 includes a track bottom 84, inside rail 86, and outside rail 88. Inside rail 86 and outside rail 88 of circular track 82 define a C-shaped channel 52, best seen in FIGS. 5*a*, 5*b*, and 7, described below.

Adjustable hand rail 10 also includes a bar 20, the bar having a gripping surface 22 so that a user of the device can get a secure grip on bar 20. Disposed within circular track 82 is a rotatable insert 32. In the embodiment of adjustable hand rail 10 shown in the Figures, rotatable insert 32 is comprised of a first insert member 34 and a second insert member 36. These two insert members combine, as described more fully below, to form rotatable insert 32. Shoulder members 38 and 40 are disposed within rotatable insert 32, and the two ends 24 and 26 of bar 20 are attached to the shoulder members. Thus, bar 20 rotates with the rotation of rotatable insert 32 within circular track 82. The mechanism by which bar 20 attaches to the shoulder members 38 and 40, and by which the shoulder members 38 and 40 are disposed within rotatable insert 32, is described more fully, below.

FIG. 1 also shows openings 46 and 48 in circular plate 14 for fastening adjustable hand rail 10 to a wall or other structure or surface. Any suitable fasteners may be used for securing adjustable hand rail 10 to a surface.

Figure 2:
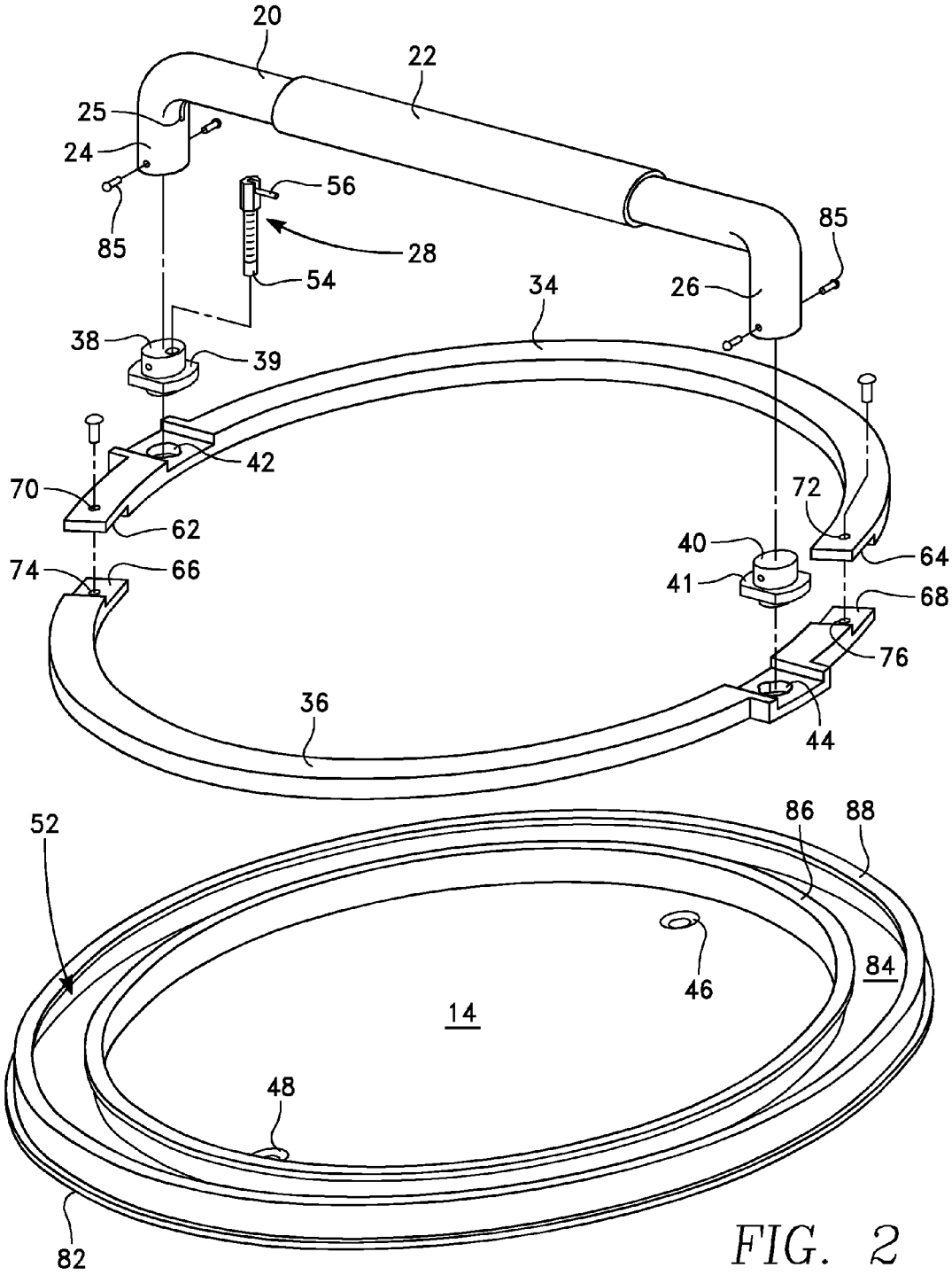
FIG. 2 is an exploded view of an embodiment of a hand rail of the present invention.

FIG. 2 provides an exploded view of one embodiment of an adjustable hand rail of the present invention. Many of the components of the present device visible in FIG. 1 are also shown here. Base member 12 and circular plate 14 are depicted, along with openings 46 and 48 for fastening the present device to a wall or other surface. Circular track 82 along a periphery of circular plate 14 is more clearly shown. As can be seen, circular track 82 includes a track bottom 84, an inside rail 86, and an outside rail 88. The inside rail 86 and outside rail 88 of circular track 82 extend from track bottom 84 and define a C-shaped channel 52 having an outward facing opening opposite track bottom 84.

Two members 34 and 36 of rotatable insert 32 are also shown. First insert member 34 is shaped as an arc or semi-circle, with flanges 62 and 64 at opposing ends thereof. Flanges 62 and 64 extend from an upper surface of first insert member 34 in the orientation shown in FIG. 2. First insert member 34 also defines a first insert opening 42. Second insert member 36 is also shaped as an arc or semi-circle, and has flanges 66 and 68 at opposing ends thereof. Flanges 66 and 68 extend from a bottom surface of insert member 36, in the orientation shown in FIG. 2, and are adapted to mate with flanges 62 and 64 of insert member 34 to produce a single, circular, rotatable insert 32. Second insert member 36 also defines a second insert opening 44. Openings 70 and 72 in insert member 34, and openings 74 and 76 in insert member 36 are adapted to receive fasteners for securing insert members 34 and 36 to one another to produce rotatable insert 32.

First insert opening 42 and second insert opening 44 are adapted to receive first shoulder member 38 and second shoulder member 40, respectively. First shoulder member 38 is substantially cylindrical and includes a first shoulder flange 39 along its length. First shoulder flange 39 is preferably wider in one direction than another. Likewise, second shoulder member 40 is substantially cylindrical and includes a second shoulder flange 41, which is also wider in one direction than another. At least one of first shoulder member 38 and second shoulder member 40 includes a locking mechanism. In the embodiment shown in FIG. 2, this mechanism (shown in first shoulder member 38) includes a hand retractable plunger 28. One end of hand retractable plunger 28 forms a locking pin 54 while a second end includes locking handle 56. First shoulder member 38 also preferably includes a biasing mechanism (such as, for example, a spring), not shown, for biasing locking pin 54 within a lock aperture in circular track 82. Applying force to locking handle 56, in a direction away from base 12 of the present device, retracts locking pin 54 from its associated lock aperture 50, thereby allowing bar 20 to rotate. This positive action for unlocking rotatable bar 20 prevents accidental unlocking and rotation of bar 20.

Bar 20 has a first end 24 and a second end 26, and is preferably substantially hollow within. First end 24 and second end 26 define openings sized and shaped to receive upper ends of first shoulder member 38 and second shoulder member 40, respectively. Bar 20 can be fastened to first shoulder member 38 and second shoulder member 40 in any suitable manner, such as, for example, by use of cotter pins or other suitable pins extending through the appropriate openings in the bar and shoulder members. Bar 20 also includes a slot 25 through which locking handle 58 can protrude.

Figure 3:
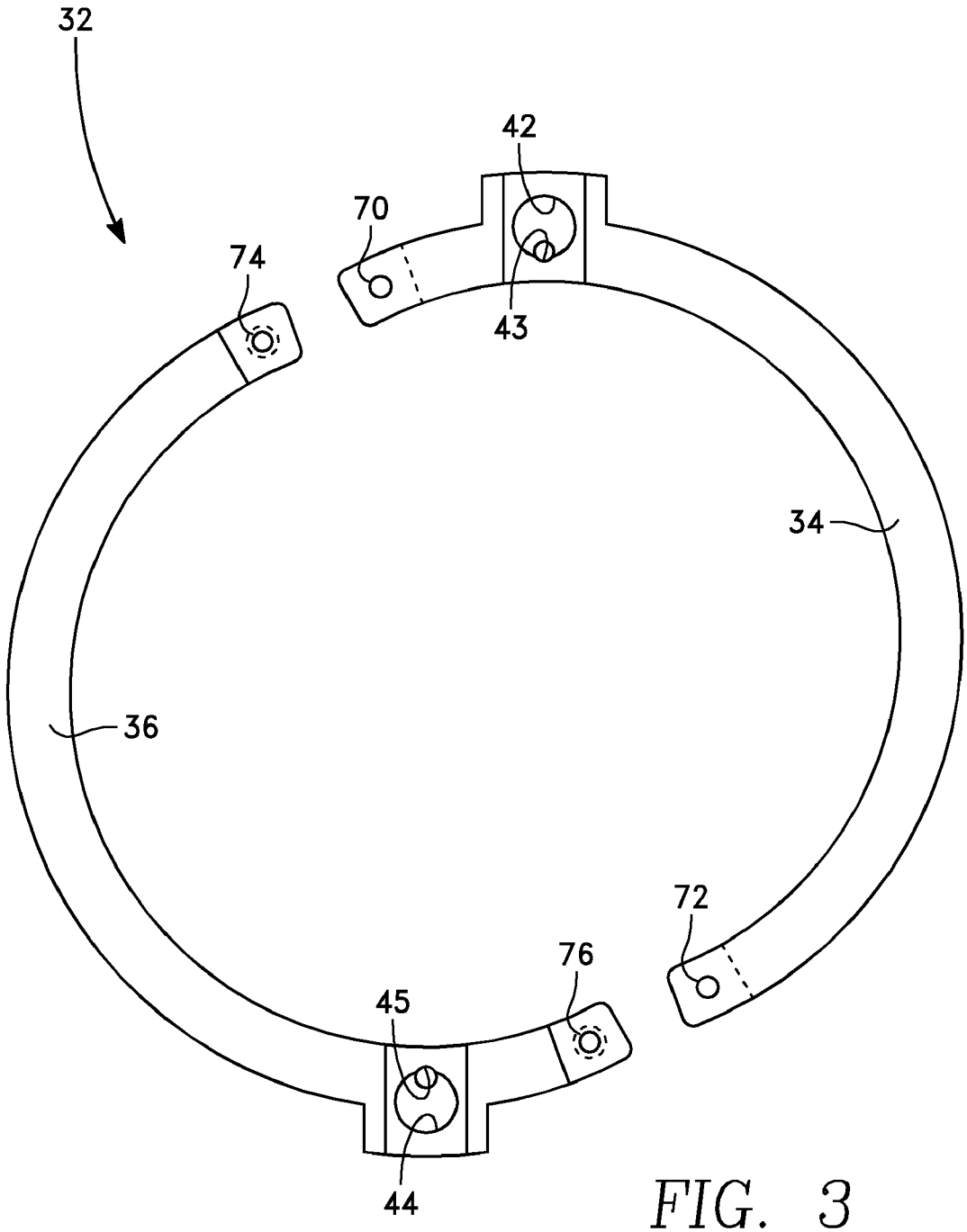
FIG. 3 is an elevation view of one embodiment of the rotatable inserts of the present invention.

FIG. 3 provides an elevation view of first insert member 34 and second insert member 36. The view provided in FIG. 3 allows visualization of the various openings in the first and second insert members. For example, first insert opening 42 and second insert opening 44 are shown. These insert openings do not extend completely through insert members 34 and 36, but instead each preferably includes a bottom against which first shoulder member 38 and second shoulder member 40, respectively, can be seated. Additional opening 43 and 45 extend the remainder of the way through insert members 34 and 36. Openings 43 and 45 are sized and shaped to receive a portion of a hand retractable plunger 28 therein, namely the portion of hand retractable plunger 28 that forms locking pin 54. In some embodiments of device 10, both first shoulder member 38 and second shoulder member 40 may include a hand retractable plunger, so that bar 20 locks to circular track 82 of base member 12 in two places. In the embodiments shown in the Figures, however, only first shoulder member 38 includes a hand retractable plunger 28, and thus it is only necessary for one of openings 43 and 45 to be present. Openings 70, 72, 74, and 76 are also shown in the flanges at opposing ends of insert members 34 and 36. Insert members 34 and 36 are designed to come together such that openings 70 and 74 mate, as do openings 72 and 76. Fasteners can then be used to attach insert member 34 and insert member 36, forming a completed rotatable member 32.

Figure 4:
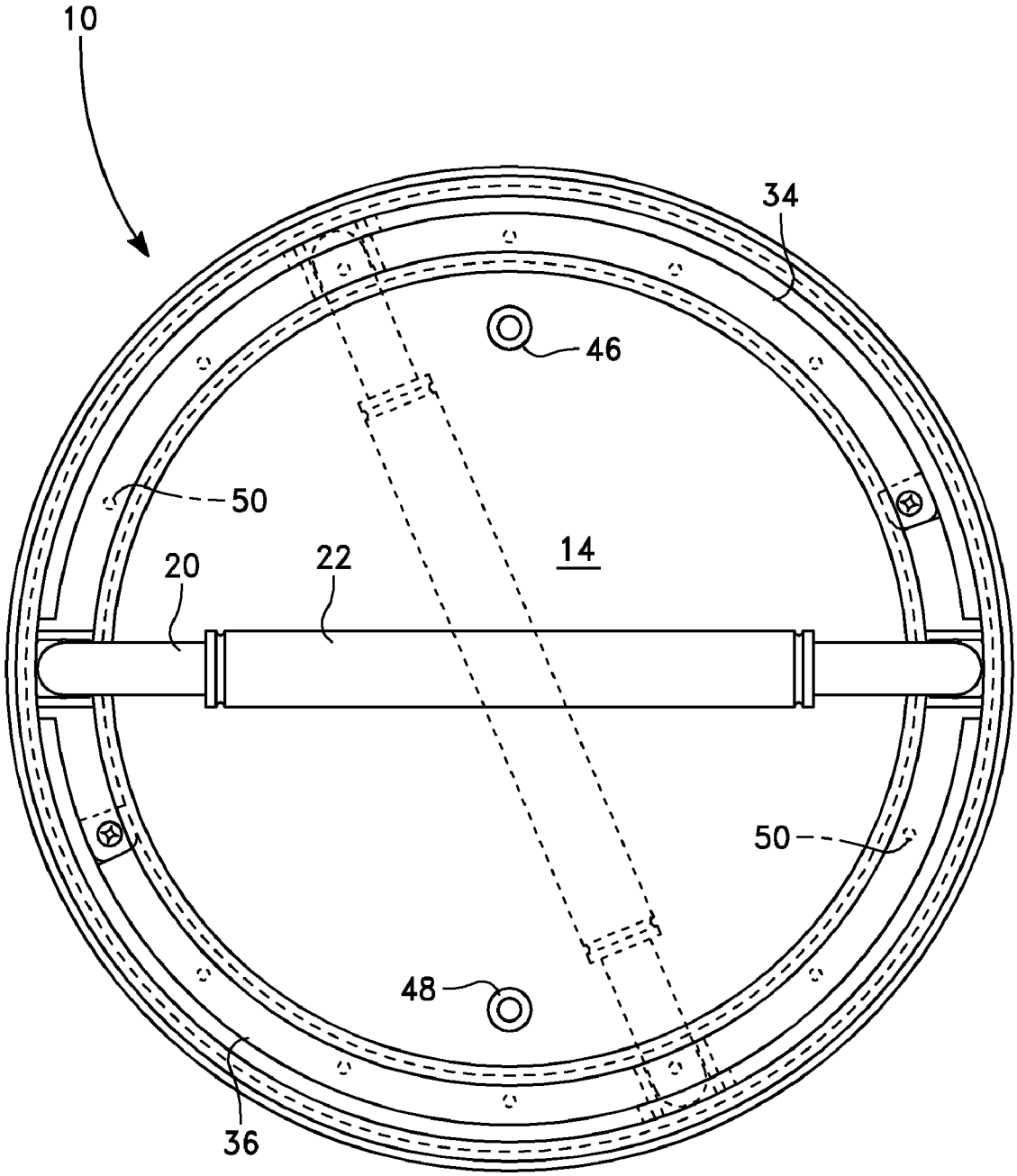
FIG. 4 is an elevation view of one embodiment of a hand rail of the present invention showing two positions of a handle thereof.

FIG. 4 provides an elevation view of one embodiment of an adjustable hand rail 10 of the present invention. Circular plate 14 is shown, with openings 46 and 48 therein. Exemplary locations of lock apertures 50 are shown in dashed lines (the apertures are located beneath the first and second insert members 34 and 36). Bar 20, with gripping surface 22 disposed thereon, is shown in a first position, and then, by dashed lines, in a second position, illustrating the rotatable nature of bar 20.

Figure 5A:
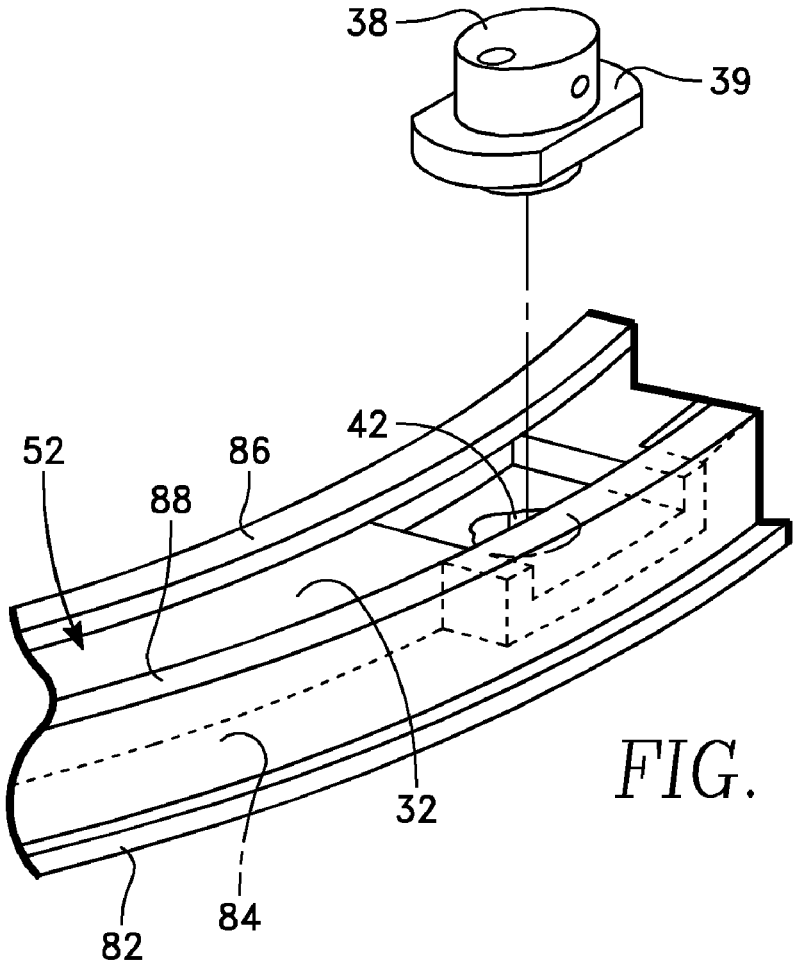
FIG. 5*a* is a perspective view of one embodiment of a shoulder member of the present invention prior to insertion into a base member thereof.

FIG. 5*a* shows a close view of a section of circular track 82, including an opening 42 in rotatable insert 32 for receiving first shoulder member 38 therein. First shoulder member 38 is shown positioned above circular track 82, prior to insertion in opening 42. As shown in the Figure, prior to insertion in opening 42 of rotatable insert 32, first shoulder member flange 39 is oriented such that the widest portions thereof are substantially in alignment with the opening defined by inside rail 86 and outside rail 88 of circular track 82. In this orientation, first shoulder members 38 can be inserted into opening 42 in rotatable insert 32. Were first shoulder member 38 oriented differently, the underside of first shoulder member flange 39 would impact the upper surfaces of inside rail 86 and outside rail 88 and first shoulder member 38 would not drop into opening 42.

Figure 5B:
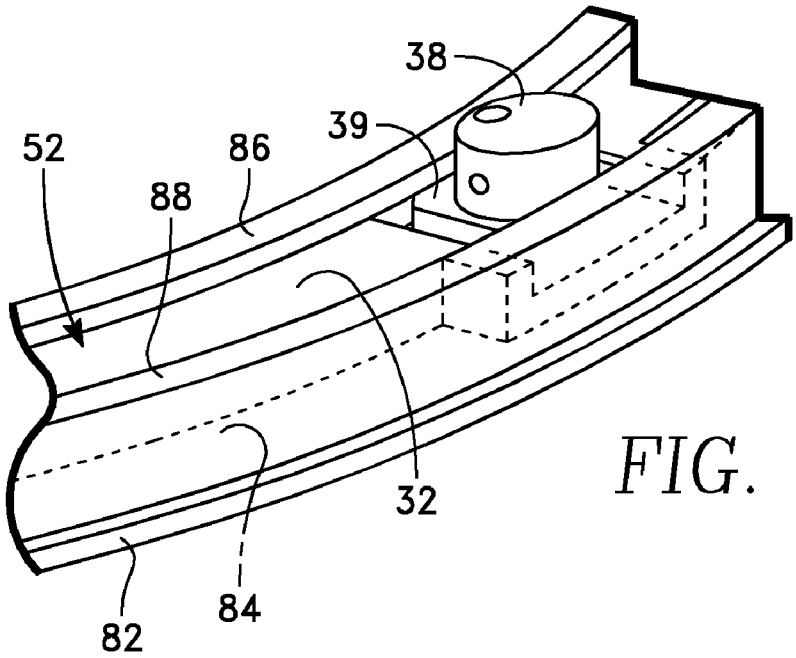
FIG. 5*b* is a perspective view of one embodiment of a shoulder member of the present invention inserted into a base member thereof.

FIG. 5*b* shows first shoulder member 38 positioned in opening 42 of rotatable insert 32. First shoulder member 38 has been rotated ninety degrees from the position shown in FIG. 5*a*, such that first shoulder member flange 39 now locks first shoulder member 38 into place within opening 42 of rotatable insert 32.

Figure 6A:
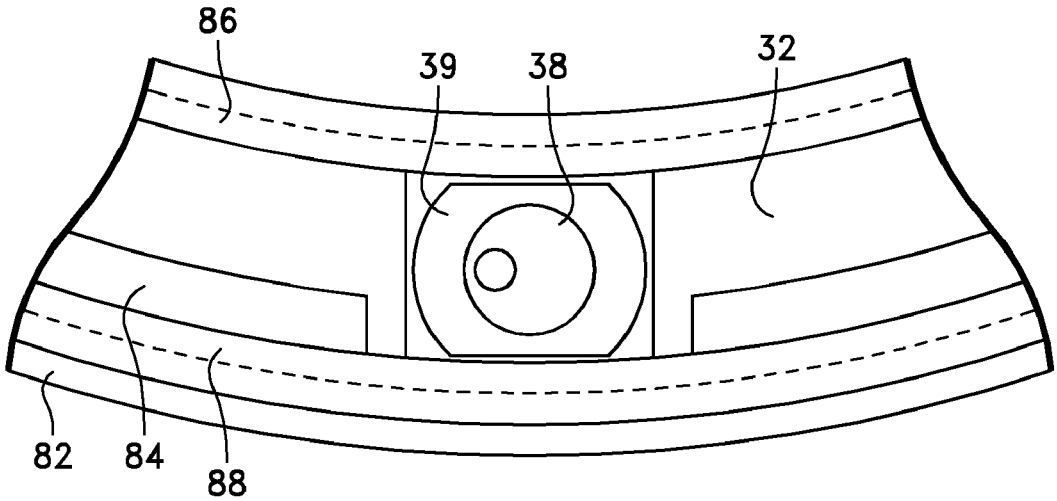
FIG. 6*a* is an elevation view of one embodiment of a shoulder member inserted into a base member of the present invention, the shoulder member in an unlocked position.

FIG. 6*a* provides an elevation view of a section of circular track 82 with first shoulder member 38 contained within opening 42 of rotatable insert 32 (opening 42 is not visible in the Figure). As shown, first shoulder member 38 is oriented such that first shoulder member flange 39 is in line with the opening of circular track 82 defined by inside rail 86 and outside rail 88. As such, first shoulder member 38 can be inserted into, and removed from, opening 42.

Figure 6B:
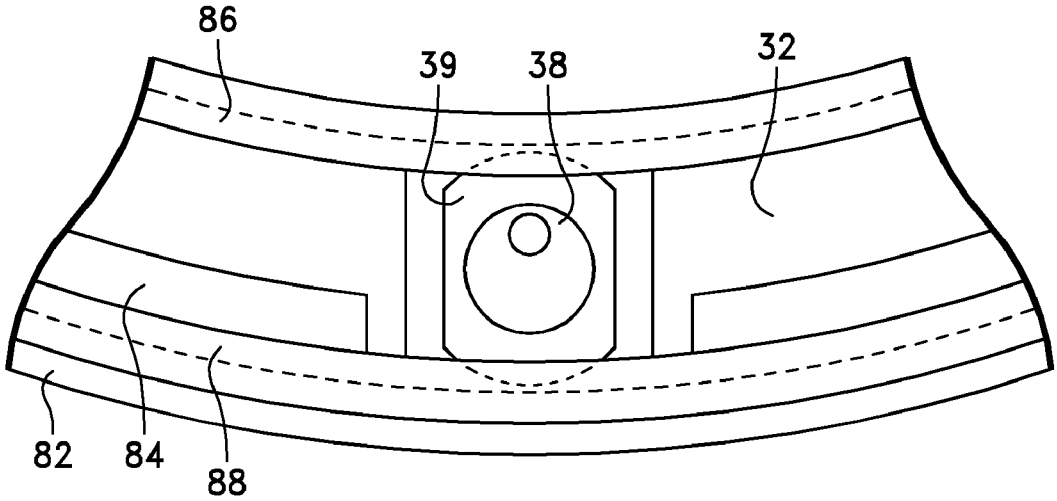
FIG. 6*b* is an elevation view of one embodiment of a shoulder member inserted into a base member of the present invention, the shoulder member in a locked position.

FIG. 6*b* shows the same view as FIG. 6*a*, but with first shoulder member 38 oriented so that first shoulder member flange 39 is received partially beneath the upper edges of inside rail 86 and outside rail 88, thereby locking first shoulder member 38 in place.

Figure 7:
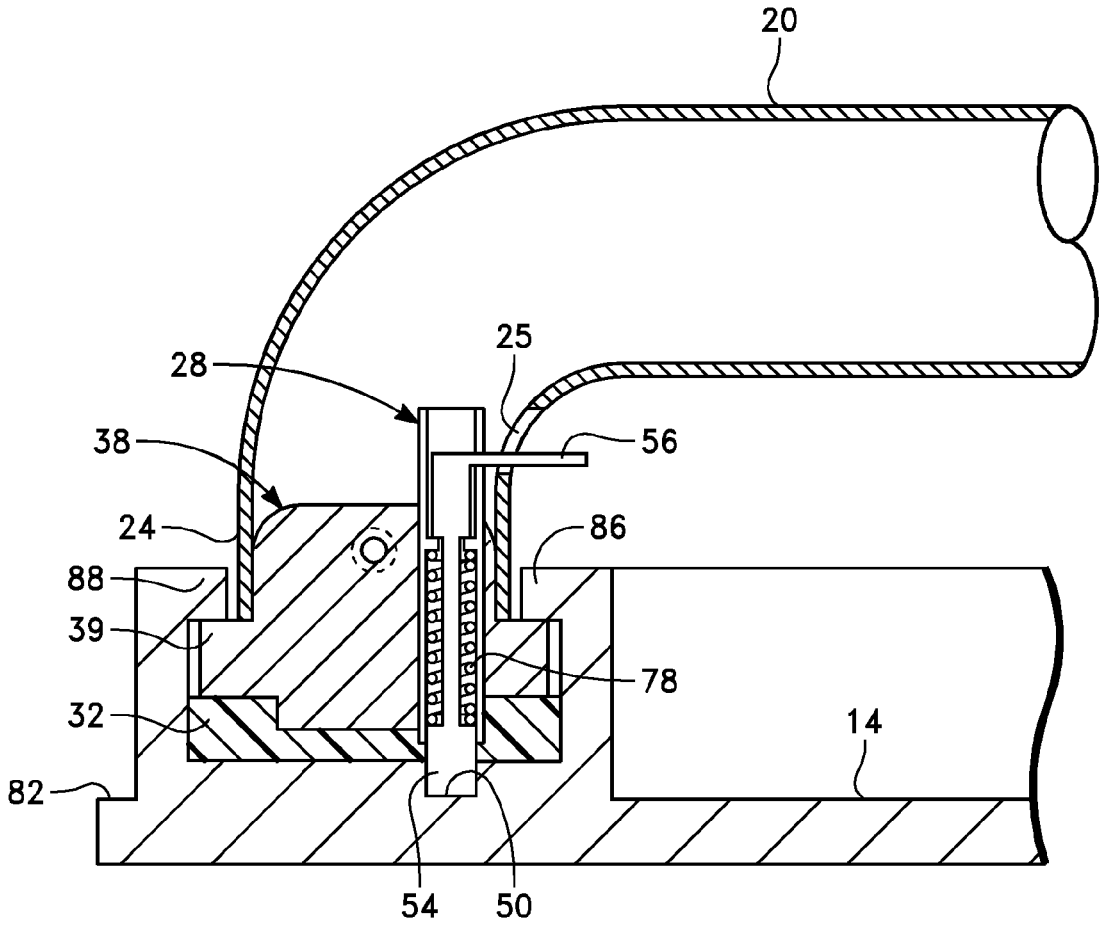
FIG. 7 is a side, cross-section view of a one embodiment of a locking mechanism of the present invention.

FIG. 7 is a cross-sectional view of one end of bar 20, having a first end member 24. Bar 20 is preferably substantially hollow and has an opening at the end where first end member 24 is present, the opening sized and shaped to receive an upper portion of first shoulder member 38 therein. First shoulder member 38 includes hand retractable plunger 28, which has an upper locking handle 56, and a lower portion defining a locking pin 54. As shown in FIG. 7, first shoulder member 38 rests within opening 42 of rotatable insert 32, with first shoulder member flange 39 locking first shoulder member 38 in place beneath the upper surfaces of inside rail 86 and outside rail 88, respectively. Locking pin 54 of hand retractable plunger 28 extends into aperture 50, thereby locking first shoulder member 38, and thus bar 20, in place and preventing it from rotating along circular track 82. A spring 78 biases hand retractable plunger 28 such that locking pin 54 is retained within aperture 50.

Figure 8A:
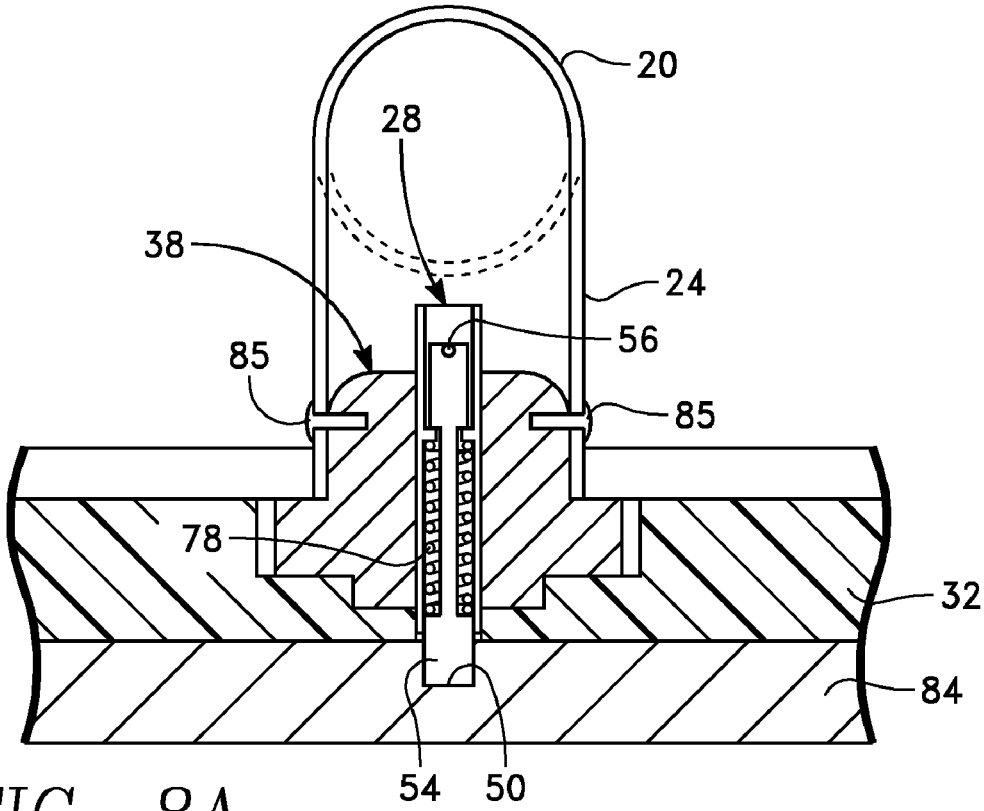
FIG. 8*a* is a cross-section view of one embodiment of a locking mechanism of the present invention in an unlocked state.

FIG. 8*a* is a cross-section view of one end of bar 20 looking from the edge of adjustable hand rail 10 toward the center of the device. In the embodiment shown in the Figure, bar 20 is attached to first shoulder member 38 via pins 85. First shoulder member 38 is shown resting in opening 42 of rotatable insert 32 in a locked position, with the locking pin portion 54 of hand retractable plunger 28 protruding into lock aperture 50. Spring 78 biases hand retractable plunger 28 downward such that locking pin 54 is within aperture 50.

Figure 8B:
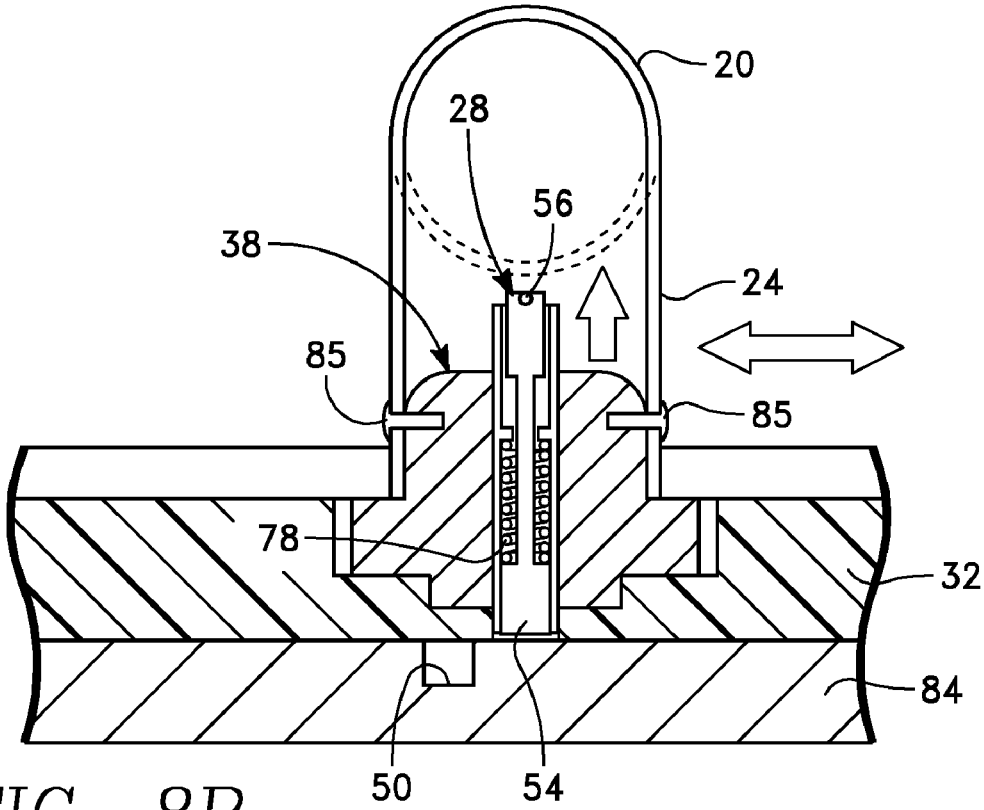
FIG. 8*b* is a cross-section view of one embodiment of a locking mechanism of the present invention in a locked state.

FIG. 8*b* shows the same view as FIG. 8*a*, but first shoulder member 38 in an unlocked position such that rotatable insert 32 is able to rotate freely and thus bar 20 can be repositioned as desired by a user of the device. First shoulder member 38 is "unlocked" by retracting locking pin 54 from lock aperture 50. This is accomplished by the user exerting a force on locking handle 56 (shown in FIG. 1) so as to retract locking pin 54. Spring 78 biases locking pin 54 downward so that, while rotatable insert 32 is being rotated, locking pin 54 will extend into another lock aperture 50 unless force is maintained against locking handle 56.

Having thus described the preferred embodiment of the invention, what is claimed as new and desired to be protected by Letters Patent includes the following:

1. An adjustable hand rail comprising:

a wall-mounted base member comprising a circular plate having an inward facing side and an outward facing side, the circular plate comprising a peripheral edge, the base member further comprising a circular track member disposed at the peripheral edge, the circular track member comprising:

a bottom;

an inside rail member extending from the bottom; and an outside rail member extending from the bottom, the inside rail member concentric with the outside rail member, wherein the inside rail member and the outside rail member define a C-shaped channel having an outward facing opening opposite the bottom, the bottom of the track member further comprising a plurality of lock apertures having generally the same diameter;

a rotatable insert rotatably disposed within the circular track member, the rotatable insert defining a first insert opening and a diametrically opposed second insert opening therein;

a first shoulder member disposed within the first insert opening, the first shoulder member comprising a first locking pin biased to extend into a first of the lock apertures and a first locking handle for retracting the first locking pin from the first lock aperture, a width of the first shoulder member larger than the outward facing opening of the C-shaped channel such that the first shoulder member is disposed within the C-shaped channel;

a second shoulder member disposed within the second insert opening, a width of the second shoulder member larger than the outward facing opening of the C-shaped channel such that the second shoulder member is disposed within the C-shaped channel; and a bar having a first end and a second end, the first end of the bar fixedly attached to the first shoulder member and the second end of the bar fixedly attached to the second shoulder member.

2. The device according to claim 1 wherein the rotatable insert comprises a first insert member and a second insert member, the first insert member defining the first insert opening and comprising a first upper flange and a second upper flange, the second insert member defining the second insert opening and comprising a first lower flange and a second lower flange, wherein when the first upper flange is mated with the first lower flange and the second lower flange is mated with the second upper flange, a substantially circular insert is formed.

3. The adjustable hand rail of claim 1 wherein the circular track is an integral part of the circular plate.

4. The adjustable hand rail of claim 1 wherein the inside rail member and outside rail member each comprise a flanged end.

5. The adjustable hand rail of claim 1 wherein the bar comprises a handle having a gripping surface.

6. The adjustable hand rail of claim 1 wherein the first shoulder member comprises a first hand retractable plunger having a first end and second end, the first end of the hand retractable plunger being the first locking pin and the second end of the hand retractable plunger being the first locking handle.

7. The adjustable hand rail of claim 1 wherein the first shoulder member comprises a first spring for biasing the first locking pin into the first of the lock apertures.

8. The device according to claim 1 wherein the second shoulder member comprises a second locking pin biased to extend into a second of the lock apertures and a second locking handle for retracting the second locking pin from the second lock aperture.

9. The device according to claim 8 wherein the second shoulder member further comprises a second hand retractable plunger having a first end and a second end, the first end of the second hand retractable plunger being the second locking pin and the second end of the second hand retractable plunger being the second locking handle.

10. An adjustable hand rail comprising:

a base member comprising a circular track having a plurality of apertures defined therein;

a rotatable insert rotatably disposed within said circular track;

a locking member associated with said rotatable insert such that rotation of the rotatable insert causes a corresponding rotation of the locking member, the locking member having a locked position and an unlocked position; and a bar fixedly attached to the rotatable insert, wherein when the locking member is in an unlocked position, the rotatable insert is able to rotate within the circular track, and when the locking member is in a locked position the locking member engages one of said plurality of apertures in the circular track and the rotatable insert is not able to rotate within the circular track.

11. The adjustable hand rail according to claim 10, wherein the locking member comprises a locking pin, and further wherein when the locking member is in a locked position the locking pin engages one of said plurality of apertures.

12. The adjustable hand rail according to claim 10, wherein the locking member comprises a hand retractable plunger.

* * * * *